US007731540B2

(12) United States Patent
Mori et al.

(10) Patent No.: US 7,731,540 B2
(45) **Date of Patent: *Jun. 8, 2010**

(54) ELECTRICAL POWER DELIVERY SYSTEM AND METHOD OF MANUFACTURING SAME

(75) Inventors: Kenneth Mori, Los Angeles, CA (US); Barry Sween, Santa Monica, CA (US)

(73) Assignee: Belkin International, Inc., Playa Vista, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/238,195

(22) Filed: Sep. 25, 2008

(65) Prior Publication Data

US 2009/0023344 A1 Jan. 22, 2009

Related U.S. Application Data

(63) Continuation of application No. 11/146,778, filed on Jun. 6, 2005, now Pat. No. 7,442,090.

(51) Int. Cl.
*H01R 25/16* (2006.01)

(52) U.S. Cl. ..... 439/652; 439/214

(58) Field of Classification Search ..... 439/652, 439/214, 535; 174/53

See application file for complete search history.

(56) References Cited

U.S. PATENT DOCUMENTS 5,562,488 A 10/1996 Neiser et al.
6,024,588 A 2/2000 Hsu et al.
6,443,772 B1 9/2002 Chen
6,666,712 B1 12/2003 Kramer
6,811,281 B1 11/2004 Hsiao
6,929,514 B1 8/2005 Chuang
6,931,702 B2 8/2005 Mitsuhashi et al.
6,948,972 B2 9/2005 Laukhuf
7,457,106 B2 * 11/2008 Ewing et al. ..... 361/623
2004/0142601 A1 7/2004 Luu
2006/0274484 A1 12/2006 Mori et al.

* cited by examiner

*Primary Examiner*—Gary F. Paumen
(74) *Attorney, Agent, or Firm*—Bryan Cave LLP

(57) ABSTRACT

In some embodiments, an electrical power delivery system including: (a) a base having: (1) a first surface; and (2) a second surface spaced apart from the first surface by a first sidewall; (b) a platform extending away from the second surface of the base, the platform having a third surface spaced apart from the second surface by a second sidewall; (c) a first electrical power outlet at the third surface; (d) a second electrical power outlet at the second sidewall; and (e) an electrical power cord. The first electrical power outlet and the second electrical power outlet are electrically coupled to the electrical power cord such that the first electrical power outlet and the second electrical power outlet receive electrical power from the electrical power cord when the electrical power cord receives electrical power.

20 Claims, 5 Drawing Sheets

ELECTRICAL POWER DELIVERY SYSTEM AND METHOD OF MANUFACTURING SAME

CROSS-REFERENCE TO RELATED APPLICATIONS

This is a continuation application of U.S. patent application Ser. No. 11/146,778, filed Jun. 6, 2005 now U.S. Pat. No. 7,442,090.

FIELD OF THE INVENTION

This invention relates generally to electrical power delivery systems, and relates more particularly to surge protectors, power strips, and the like having electrical power outlets therein.

BACKGROUND OF THE INVENTION

Electric devices require electric power in order to function, and electrical power delivery systems of many descriptions have been developed for the purpose of delivering such power. Electrical power delivery systems include wall outlets, wall adapters, power strips, and surge protectors that deliver electric power in the form of alternating current (AC). Wall outlets are perhaps the oldest of the mentioned systems, but wall outlets typically provided no more than two electrical power outlets. At least part of the motivation for the development of wall adapters, power strips, and/or surge protectors was the provision of multiple electrical power outlets in the same space or area where there originally were only one or two. It is now quite common for a wall outlet, perhaps a wall outlet near a computer desk, for example, to have plugged into it a power strip or the like, whereby a single electrical power outlet supplies power to as many as twelve or more electrical power outlets in the surge protector.

Existing surge protectors, power strips, wall adapters, and the like work well as far as the provision of multiple electrical power outlets is concerned, but in other ways they are less than ideal, including their use of space and their cord management abilities. Accordingly, there exists a need for an electrical power delivery system that is neat and compact, easy to use, and allows cables and cords to be managed.

DESCRIPTION OF THE DRAWINGS

The invention will be better understood from a reading of the following detailed description, taken in conjunction with the accompanying figures in the drawings in which.

Figure 1:
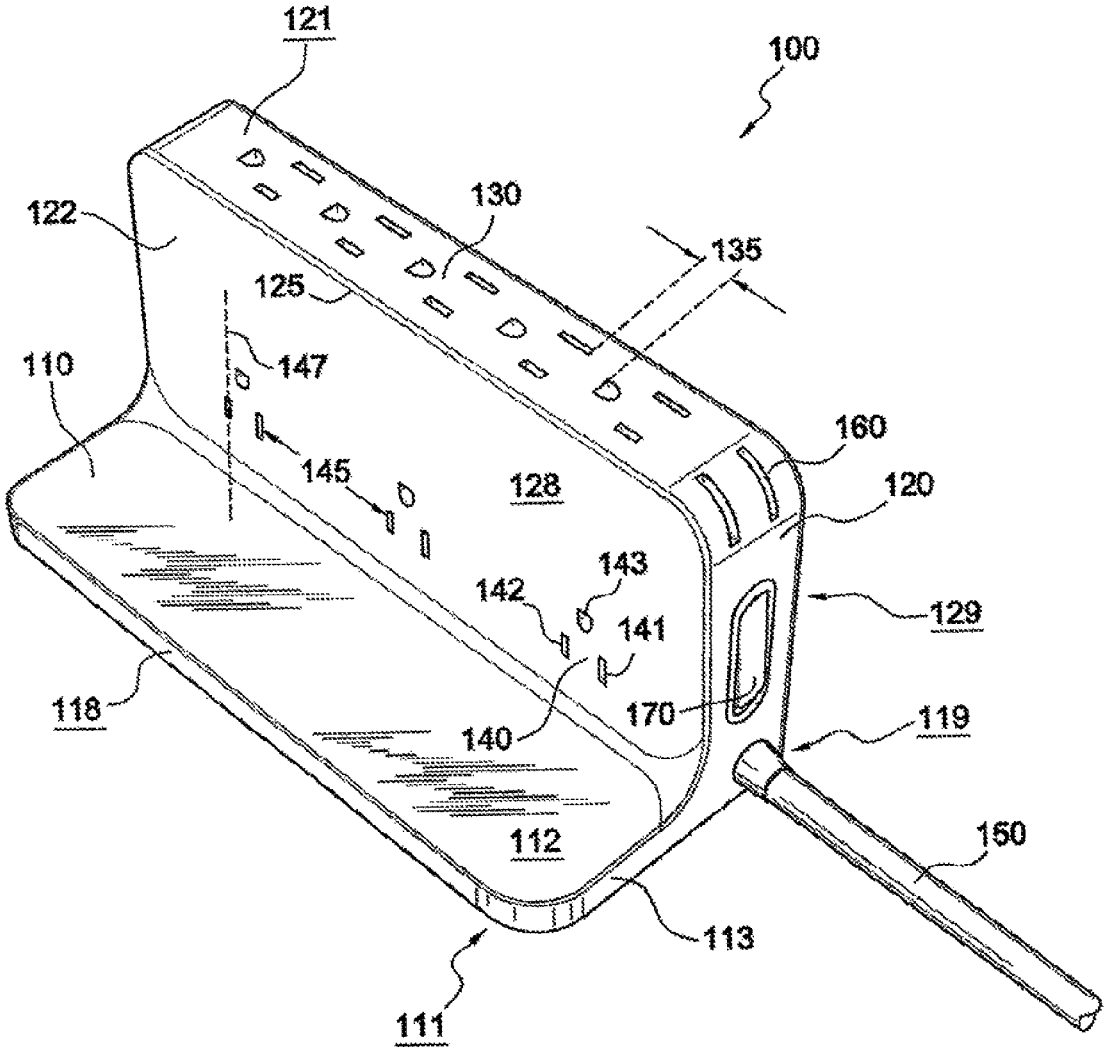
FIG. 1 is a perspective view of an electrical power delivery system according to an embodiment of the invention.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Furthermore, the terms "comprise," "include," "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein. The term "coupled," as used herein, is defined as directly or indirectly connected in an electrical, mechanical, or other manner.

DETAILED DESCRIPTION OF THE DRAWINGS

In one embodiment of the invention, an electrical power delivery system comprises a base having a first surface and a second surface spaced apart from the first surface by a first sidewall. The electrical power delivery system also comprises a platform extending away from the second surface of the base such that the platform covers a portion of but less than all of the second surface. The platform itself includes a third surface substantially parallel to the second surface and spaced apart from the second surface by a second sidewall that is substantially perpendicular to the second surface. A first electrical power outlet is located at the third surface, and a second electrical power outlet is located at the second sidewall. An electrical power cord is physically and electrically coupled either to the base or to the platform.

As will be described in detail below, the electrical power delivery system is constructed in such a way that the power cords that are plugged into the electrical power delivery system become arranged in an aesthetically pleasing and easily-managed pattern. Furthermore, the construction of the electrical power delivery system offers a relatively large number of electrical power outlets in a relatively small amount of space. Where the base of the electrical power delivery system is placed on the floor, the footprint of the electrical power delivery system is small and compact relative to the number of electrical power outlets provided.

Referring flow to the figures, FIG. 1 is a perspective view of an electrical power delivery system 100 according to an embodiment of the invention. As illustrated in FIG. 1, electrical power delivery system 100 comprises a base 110 comprising a surface 111 and a surface 112 spaced apart from surface 111 by a sidewall 113. Surface 111 is the surface on which electrical power delivery system 100 rests when electrical power delivery system 100 is placed on the floor or another horizontal surface. Accordingly, surface 111 is substantially flat so that electrical power delivery system 100 is stable when positioned on the floor or other horizontal surface. Sidewall 113 comprises a face 118 and a face 119 spaced apart from and substantially parallel to face 118. Face 119 is not visible in FIG. 1, but is indicated by a curving arrow next to reference numeral 119.

Electrical power delivery system 100 also comprises a platform 120 extending away from surface 112 of base 110 such that platform 120 covers a portion of but less than all of surface 112. Platform 120 comprises a surface 121 that is substantially parallel to surface 112 and is spaced apart from surface 112 by a sidewall 122. Sidewall 122 is substantially perpendicular to surface 112. In addition, sidewall 122 comprises a face 128 and a face 129 spaced apart from and substantially parallel to face 128. In the illustrated embodiment, face 128 is the vertical surface separating surface 112 and surface 121. Face 129 is not visible in FIG. 1, but it is indicated by a reference numeral. Sidewall 122 also comprises additional faces not further described herein but visible in the figures.

In the illustrated embodiment, platform 120 extends away from surface 112 such that face 119 of sidewall 113 and face 129 of sidewall 122 are continuous with each other. An advantage of such an embodiment is that faces 119 and 129 may for reasons of aesthetics, space management, or the like be placed flush against a wall, a table leg, or a similar vertical surface.

Electrical power delivery system 100 also comprises an electrical power outlet 130 at surface 121, an electrical power outlet 140 at sidewall 122, and a power cord 150 physically and electrically coupled to one of base 110 and platform 120. In the illustrated embodiment, electrical power outlet 140 is at face 128. Also in the illustrated embodiment, power cord 150 is physically and electrically coupled in such a way that it touches base 110 and platform 120, a situation that is hereby stated to be within the scope of the phrase "physically and electrically coupled to one of base 110 and platform 120." In other words, the phrase "coupled to one of base 110 and platform 120" is not limited to a situation in which power cord 150 is coupled to only one of base 110 and platform 120.

As shown in FIG. 1, electrical power outlet 130 is one of a plurality of electrical power outlets located at surface 121. Each one of the electrical power outlets located at surface 121 is substantially similar to each other one of the electrical power outlets located at surface 121. Accordingly, the phrase "electrical power outlet 130" may be used herein to indicate any single one or any group of such electrical power outlets, as indicated by the context. Five such outlets are shown in the illustrated embodiment; non-illustrated embodiments may comprise some other number of such outlets at surface 121. As an example, electrical power delivery system 100 may comprise as few as three or as many as twelve electrical power outlets at surface 121, although numbers outside this range are also possible.

As is also shown in FIG. 1, electrical power outlet 140 is one of a plurality of electrical power outlets located at sidewall 122. Each one of the electrical power outlets located at sidewall 122 is substantially similar to each other one of the electrical power outlets located at sidewall 122. Accordingly, the phrase "electrical power outlet 140" may be used herein to indicate any single one or any group of such electrical power outlets, as indicated by the context. Three such outlets are shown in the illustrated embodiment; non-illustrated embodiments may comprise some other number of such outlets at sidewall 122. As an example, electrical power delivery system 100 may comprise as few as one or as many as six electrical power outlets at sidewall 122, although numbers outside this range are also possible.

Surface 121 and sidewall 122 are in physical contact with each other along a dividing line 125. Dividing line 125 can be, but is not necessarily, a physical line or other physical feature such as a change in surface contour. It may not exist at all except as an invisible and/or intangible boundary that separates surface 121 from sidewall 122. Dividing line 125 need not be a straight line, although it is a straight line in the illustrated embodiments Adjacent ones of plurality of electrical power outlets 130 are spaced apart from each other by a distance 135, as shown. Similarly, adjacent ones of plurality of electrical power outlets 140 are spaced apart from each other by a distance 145. In the illustrated embodiment, distance 145 is greater than distance 135, although such spacing is not a requirement for all embodiments of electrical power delivery system 100, Each one of plurality of electrical power outlets 140 comprises a neutral aperture 141, a hot aperture 142, and a ground aperture 143. Hot aperture 142 has a long axis 147 that is substantially perpendicular to dividing line 125. Ground aperture 143 is closer to dividing line 125 than are hot aperture 142 and neutral aperture 141. An advantage of the geometry just described will be discussed below in connection with FIG. 2.

Electrical power delivery system 100 further comprises indicator lights 160 and an on/off switch 170. The locations of indicator lights 160 and on/off switch 170 as shown in FIG. 1 are suitable, but not required, locations for the stated elements. In one embodiment, light source 160 comprises one or more light emitting diodes (LEDs) that indicate various operating states of electrical power delivery system 100, including, for example, normal operation in surge protected mode, faulty operation, or operation in non-surge-protected mode, and the like. In the same or another embodiment, on/off switch 170 is capable of preventing or allowing the flow of electrical power into electrical power delivery system 100, depending on whether it is in the on or the off position. Both on/off switch 170 and light sources 160 are common features of existing surge protectors, and thus will not be further described herein.

Figure 2:
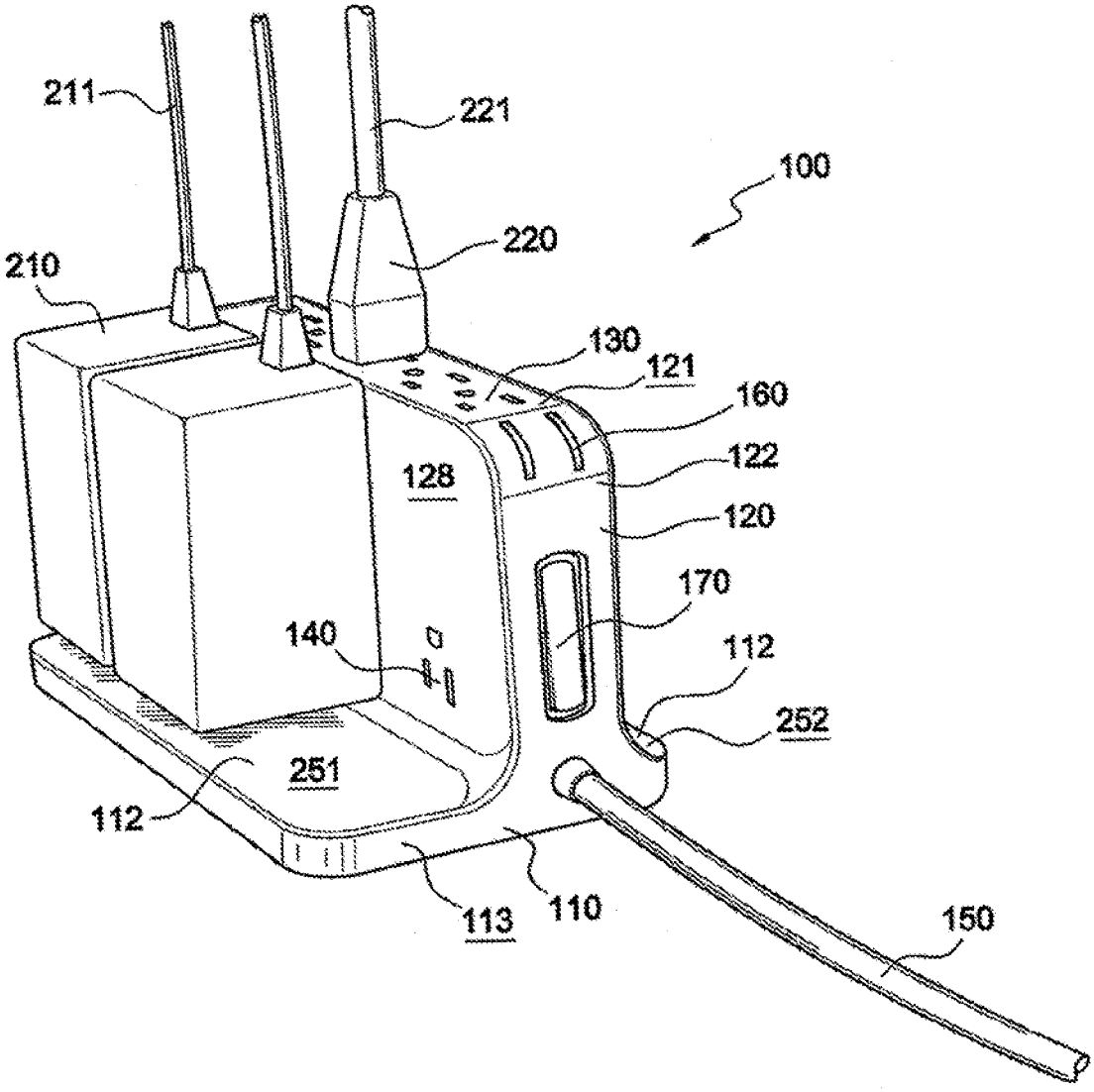
FIG. 2 is a perspective view of an electrical power delivery system showing various electric power plugs inserted therein according to an embodiment of the invention.

FIG. 2 is a perspective view of electrical power delivery system 100 showing various electric power plugs inserted therein according to an embodiment of the invention. The embodiment shown in FIG. 2 differs slightly from that shown in FIG. 1, but the difference is small enough that the same reference numerals are used in both figures, and the electrical power delivery systems in both FIG. 1 and FIG. 2 are referred to as electrical power delivery system 100. The slight difference between the FIG. 1 and FIG. 2 depictions lies in the positioning of platform 120 on base 110. In the embodiment of FIG. 1, platform 120 extended away from an edge of base 110 so as to present a flat surface that could be placed flush against a wall or the like. In the embodiment of FIG. 2, platform 120 extends away from a middle region of surface 112 such that platform 120 divides surface 112 into a section 251 and a section 252. As illustrated, section 251 is adjacent to face 128.

Section 251 has a first surface area. Section 252 has a second surface area. In the illustrated embodiment, the first surface area exceeds the second surface area. An advantage of the embodiment of FIG. 2 is that electrical power delivery system 100 may still be placed near, though not flush with, a wall or the like, while possibly offering greater stability and/or balance than the embodiment of FIG. 1.

As illustrated in FIG. 2, an electric power plug 210 is inserted into electrical power outlet 140 and an electric power plug 220 is inserted into electrical power outlet 130. Electric power plug 210 is of the type often referred to as a "power brick" or simply as a "brick," one characteristic of which is that its electric power cord, such as an electric power cord 21 1, exits the power brick in a direction lying at approximately 90 degrees to a direction in which the prongs (not shown) exit the power brick. By contrast, an electric power cord 221 of electric power plug 220 exits electric power plug 220 in a direction lying at approximately 180 degrees to a direction in which the prongs (not shown) exit electric power plug 220. For convenience, plugs having this 180 degree separation between prongs and cord will be referred to herein as "straight plugs."

The shape of electrical power delivery system 100, and the particular orientation of electrical power outlets 130 and 140 described above and shown in FIGS. 1 and 2, make it possible for electric power cord 211 to extend away from electrical power delivery system 100 in the same direction as electric power cord 221, despite the difference in the separation angle between cords and plugs that was discussed in the immediately preceding paragraph. The same effect may be achieved regardless of the orientation of electrical power outlets 130 provided that all power bricks plugged into electrical power delivery system 100 are placed in electrical power outlets 140 and all straight plugs plugged into electrical power delivery system 100 are placed in electrical power outlets 130. The illustrated geometry is optimized for such placement of power bricks and straight plugs, in that distance 145, which in the illustrated embodiment is greater than distance 135, is sufficient to accommodate the typically larger physical size of the power bricks as compared to the straight plugs. If power bricks are instead placed in electrical power outlets 130 and straight plugs in electrical power outlets 140 the same effect may still be achieved given different constraints on the orientation of electrical power outlets 130 and 140, as will be further described below.

Electrical power delivery system 100, by allowing cord arrangements in which all electric power cords exit in the same direction, represents a significant advance over existing power delivery systems. As an example, cord management, whether it is undertaken for reasons of safety, aesthetics, and/or convenience or for some other reason, becomes much easier when all cords are initially traveling in the same direction.

Figure 3:
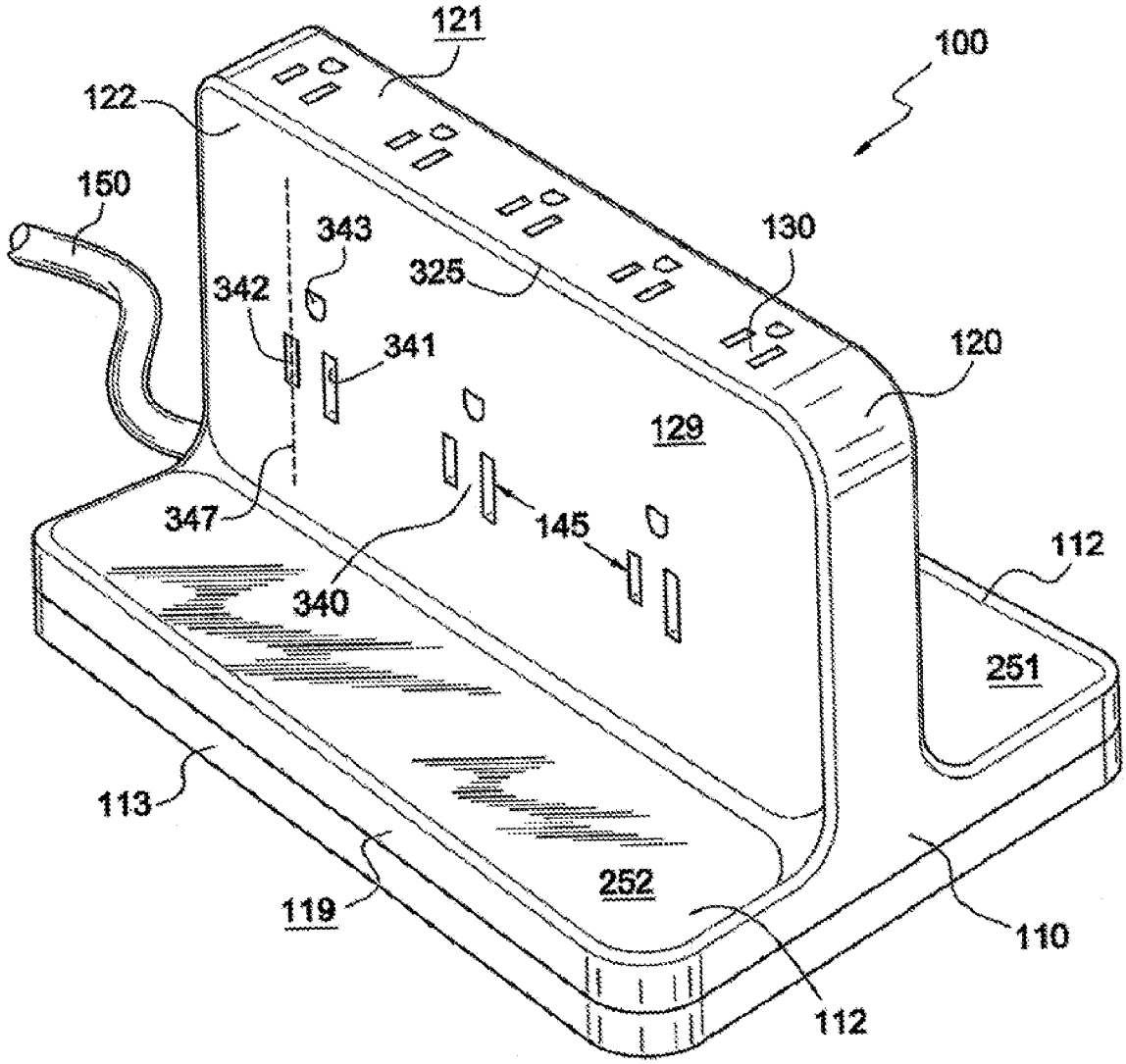
FIG. 3 is a view from a different perspective of an electrical power delivery system according to an embodiment of the invention.

FIG. 3 is a view from a different perspective of electrical power delivery system 100 according to an embodiment of the invention. As illustrated in FIG. 3, electrical power delivery system 100 further comprises an electrical power outlet 340 at face 129 of sidewall 122. Electrical power outlet 340 is one of a plurality of electrical power outlets located at face 129. Each one of the electrical power outlets located at face 129 is substantially similar to each other one of the electrical power outlets located at face 129. Accordingly, the phrase "electrical power outlet 340" may be used herein to indicate any single one or any group of such electrical power outlets, as indicated by the context. Three such outlets are shown in the illustrated embodiment; non-illustrated embodiments may comprise some other number of such outlets at face 129. As an example, electrical power delivery system 100 may comprise as few as one or as many as six electrical power outlets at face 129, although numbers outside this range are also possible.

As mentioned above, FIG. 1 depicts an embodiment of electrical power delivery system 100 in which platform 120 extended away from an edge of base 110 so as to present a flat surface that could be placed flush against a wall or the like. FIG. 2 depicts an embodiment of electrical power delivery system 100 in which platform 120 extends away from a middle region of surface 112 such that platform 120 divides surface 112 into a section 251 and a section 252, where the surface area of section 251 exceeds the surface area of section 252. In FIG. 3, the surface area of section 251 and the surface area of section 252 are substantially equal to each other. An advantage of the FIG. 3 embodiment of electrical power delivery system 100 is that its balance and stability are enhanced even beyond that of the embodiment of FIG. 2. Another advantage, at least to some, may be an aesthetically pleasing symmetry that was absent from the embodiments of FIGS. 1 and 2. It is understood, of course, that an appreciation of such symmetry is a matter of personal opinion.

Figure 4:
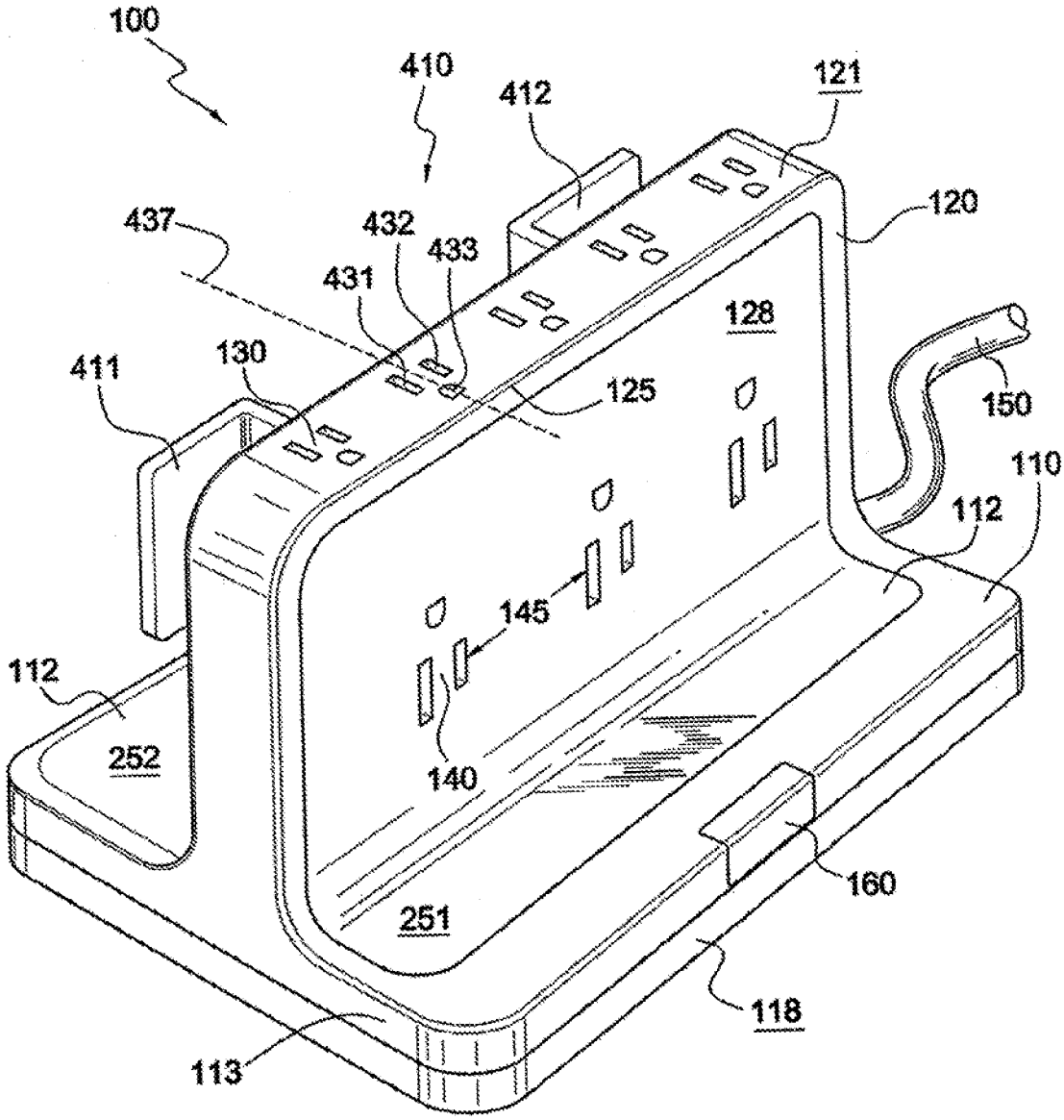
FIG. 4 is another perspective view of an electrical power delivery system according to an embodiment of the invention.

FIG. 4 is another perspective view of electrical power delivery system 100 according to an embodiment of the invention. The embodiment of electrical power delivery system 100 shown in FIG. 4 differs slightly from those shown in FIGS. 1-3, but the difference is small enough that the same reference numerals that were used in the preceding figures are also used to indicate the same features in FIG. 4, and the electrical power delivery system ill FIG. 4 is referred to as electrical power delivery system 100, just as was the case for the electrical power delivery systems of the previous figures. Note that light source 160 is shown in FIG. 4 to be located at base 110 rather than on platform 120 as was the case in FIGS. 1 and 2. Additional locations besides those illustrated herein are also possible.

As illustrated in FIG. 4, face 129 of sidewall 122 comprises a cord management feature 410 comprising a cord wrap arm 41 1 and an opposing cord wrap arm 412. As an example, one or more power cords, such as electric power cord 211 and/or electric power cord 212 (see FIG. 2) may be wrapped around cord wrap arms 411 and 412 in order to neatly maintain such power cord or cords in a well-defined space. Although they are not illustrated, additional cord management features in addition to cord management feature 410 may also be used in connection with electrical power delivery system 100. As an example, the non-illustrated cord management feature could be a cord clip, a cord reel or spool, or the like.

Referring again to FIG. 3, and still to FIG. 4, it may be seen that surface 121 and face 129 of sidewall 122 are in physical contact with each other along a dividing line 325, and that adjacent ones of plurality of electrical power outlets 340 are spaced apart from each other by distance 145. As mentioned above, in one embodiment, distance 145 is large enough that each one of electrical power outlets 140 can accommodate a power brick.

In a manner similar to that discussed above for electrical power outlets 130 and 140, electrical power outlet 340 comprises a neutral aperture 341, a hot aperture 342, and a ground aperture 343, hot aperture 342 has a long axis 347, and long axis 347 is substantially perpendicular to dividing line 325. Furthermore, ground aperture 343 is closer to dividing line 325 than are hot aperture 342 and neutral aperture 341.

The described orientation of electrical power outlets, as well as other orientations to be described below, offer the same advantages that were described above in connection with FIG. 2 with respect to the direction in which electric power cords associated with power bricks and straight plugs move away from electrical power delivery system 100. FIG. 4 illustrated another orientation in which the stated advantages may be realized. In the FIG. 4 orientation, electrical power outlet 130 comprises a neutral aperture 431, a hot aperture 432, and a ground aperture 433. Hot aperture 432 has a long axis 437, and long axis 437 is substantially perpendicular to dividing line 125. Furthermore, ground aperture 433 is closer to dividing line 125 than are hot aperture 432 and neutral aperture 431. With electrical power outlets 130 oriented as just described, the stated advantages may be realized if electrical power outlets 130 are used for power bricks and electrical power outlets 140 are used for straight plugs. The foregoing is true regardless of the orientation of electrical power outlets 140.

Figure 5:
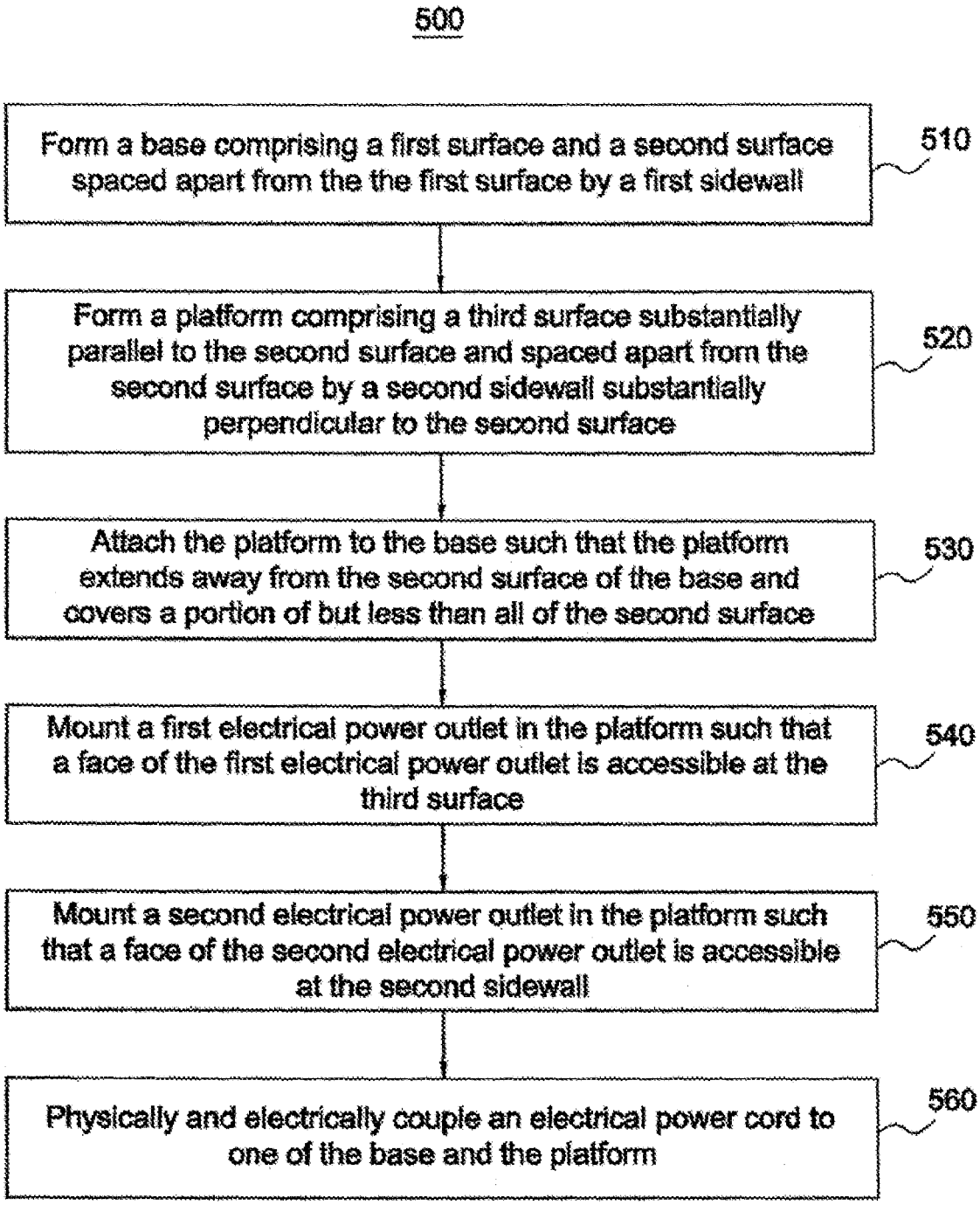
FIG. 5 is a flowchart illustrating a method of manufacturing an electrical power delivery system according to an embodiment of the invention.

FIG. 5 is a flowchart illustrating a method 500 of manufacturing an electrical power delivery system according to an embodiment of the invention. A step 510 of method 500 is to form a base comprising a first surface and a second surface spaced apart from the first surface by a first sidewall. As an example, the base can be similar to base 110, first shown in FIG. 1.

A step 520 of method 500 is to form a platform comprising a third surface substantially parallel to the second surface and spaced apart from the second surface by a second sidewall substantially perpendicular to the second surface. As an example, the platform can be similar to platform 120, first shown in FIG. 1.

A step 530 of method 500 is to attach the platform to the base such that the platform extends away from the second surface of the base and covers a portion of but less than all of the second surface.

A step 540 of method 500 is to mount a first electrical power outlet in the platform such that a face of the first electrical power outlet is accessible at the third surface. As an example, the first electrical power outlet can be similar to electrical power outlet 130, first shown in FIG. 1.

A step 550 of method 500 is to mount a second electrical power outlet in the platform such that a face of the second electrical power outlet is accessible at the second sidewall. As an example, the second electrical power outlet can be similar to electrical power outlet 140, first shown in FIG. 1.

A step 560 of method 500 is to physically and electrically couple an electrical power cord to one of the base and the platform. As an example, the electric power cord can be similar to power cord 150, first shown in FIG. 1.

In one embodiment, steps 510, 520, 530, 540, and 550 are performed simultaneously with each other in an injection molding process.

Although the invention has been described with reference to specific embodiments, it will be understood by those skilled in the art that various changes may be made without departing from the spirit or scope of the invention. Various examples of such changes have been given in the foregoing description. Accordingly, the disclosure of embodiments of the invention is intended to be illustrative of the scope of the invention and is not intended to be limiting. It is intended that the scope of the invention shall be limited only to the extent required by the appended claims. For example, to one of ordinary skill in the art, it will be readily apparent that the electrical power delivery system discussed herein may be implemented in a variety of embodiments, and that the foregoing discussion of certain of these embodiments does not necessarily represent a complete description of all possible embodiments. Rather, the detailed description of the drawings, and the drawings themselves, disclose at least one preferred embodiment of the invention, and may disclose alternative embodiments of the invention.

All elements claimed in any particular claim are essential to the invention claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under: the doctrine of dedication if the embodiments and/or limitations: (1) are not expressly claimed in the claims, and (2) are or are potentially equivalents of express elements and/or limitations in the claims under the doctrine of equivalents.

What is claimed is:

1. An electrical power delivery system comprising:
a base comprising:
a first surface; and
a second surface spaced apart from the first surface by a first sidewall;
a platform extending away from the second surface of the base, the platform comprising:
a third surface spaced apart from the second surface by a second sidewall;
a first electrical power outlet at the third surface;
a second electrical power outlet at the second sidewall; and
an electrical power cord,
wherein:
the first electrical power outlet and the second electrical power outlet are electrically coupled to the electrical power cord such that the first electrical power outlet and the second electrical power outlet receive electrical power from the electrical power cord when the electrical power cord receives electrical power.

2. The electrical power delivery system of claim 1, further comprising:
a third electrical power outlet,
wherein:
the second sidewall comprises:
a first face; and
a second face;
the third electrical power outlet is located at the first face; and
the second electrical power outlet is located at the second face.

3. The electrical power delivery system of claim 2, wherein:
the first face is adjacent to the second face.

4. The electrical power delivery system of claim 2, wherein:
the first face is spaced apart from the second face.

5. The electrical power delivery system of claim 2, further comprising:
at least one fourth electrical power outlet at the third surface.

6. The electrical power delivery system of claim 1, wherein:
the first, second, and third surfaces are substantially parallel to each other.

7. The electrical power delivery system of claim 1, wherein:
the second electrical power outlet comprises a hot aperture, a neutral aperture, and a ground aperture; and
the ground aperture is closer to the third surface than the second surface.

8. The electrical power delivery system of claim 1, wherein:
the platform extends away from a middle region of the second surface.

9. The electrical power delivery system of claim 8, wherein:

a first portion of the second surface is located at a first end of the platform; and a second portion of the second surface is located at a second end of the platform.

10. The electrical power delivery system of claim 1, wherein:

a surface area of the third surface is less than a surface area of the first surface.

11. The electrical power delivery system of claim 1, further comprising:

a cord management feature at the second sidewall.

12. The electrical power delivery system of claim 1, wherein:

the second sidewall comprises:

a first face; and a second face spaced apart from the first face;

the second electrical power outlet is at the first face; and the platform extends away from the second surface such that a first face of the first sidewall and the second face of the second sidewall are continuous with each other.

13. An electrical power delivery system comprising:

a base comprising:

a first surface; and a second surface spaced apart from the first surface by a first sidewall;

a platform extending away from the second surface of the base, the platform comprising:

a third surface spaced apart from the second surface by a second sidewall, the second sidewall comprising:

a first face; and a second face spaced apart from the first face;

at least one first electrical power outlet at the third surface;

at least one second electrical power outlet at the first face of the second sidewall; and an electrical power cord, wherein:

the at least one first electrical power outlet and the at least one second electrical power outlet are electrically coupled to the electrical power cord such that the at least one first electrical power outlet and the at least one second electrical power outlet receive electrical power from the electrical power cord when the electrical power cord receives electrical power, the third surface and the first face are in physical contact with each other along a first dividing line;

the third surface and the second face are in physical contact with each other along a second dividing line;

the at least one first electrical power outlet comprises a first hot aperture, a first neutral aperture, and a first ground aperture;

the at least one second electrical power outlet at comprises a second hot aperture, a second neutral aperture, and a second ground aperture;

the first hot aperture has a first long axis and the second hot aperture has a second long axis;

the first long axis and the second long axis are substantially perpendicular to the first dividing line;

the first ground aperture is closer to the first dividing line than are the first hot aperture and the first neutral aperture; and the second ground aperture is closer to the first dividing line than are the second hot aperture and the second neutral aperture.

14. The electrical power delivery system of claim 3, further comprising:

at least one third electrical power outlet at the second face.

15. The electrical power delivery system of claim 14, wherein:

the at least one third electrical power outlet comprises a third hot aperture, a third neutral aperture, and a third ground aperture;

the third hot aperture has a third long axis;

the third long axis is substantially perpendicular to the second dividing line; and the third ground aperture is closer to the second dividing line than are the third hot aperture and the third neutral aperture.

16. The electrical power delivery system of claim 13, wherein:

the platform extends away from the second surface such that a first face of the first sidewall and the second face of the second sidewall are continuous with each other.

17. A method of manufacturing an electrical power delivery system, the method comprising:

forming a base comprising:

a first surface; and a second surface spaced apart from the first surface by a first sidewall;

forming a platform comprising a third surface spaced apart from the second surface by a second sidewall;

mounting a first electrical power outlet such that a face of the first electrical power outlet is accessible at the third surface;

mounting a second electrical power outlet such that a face of the second electrical power outlet is accessible at the second sidewall;

electrically coupling an electrical power cord to the first electrical power outlet and the second electrical power outlet such that the first electrical power outlet and the second electrical power outlet receive electrical power when the electrical power cord receives electrical power.

18. The method of claim 17, wherein:

forming the base and forming the platform are performed simultaneously with each other.

19. The method of claim 17, wherein:

forming the platform comprises:

forming the platform comprising the third surface spaced apart from the second surface by the second sidewall and a third sidewall; and further comprising:

mounting a third electrical power outlet such that a face of the third electrical power outlet is accessible at the third sidewall.

20. The method of claim 17, further comprising:

mounting at least one fourth electrical power outlet such that a face of the at least one fourth electrical power outlet is accessible at the third surface.

* * * * *

UNITED STATES PATENT AND TRADEMARK OFFICE

CERTIFICATE OF CORRECTION

PATENT NO. : 7,731,540 B2
APPLICATION NO. : 12/238195
DATED : June 8, 2010
INVENTOR(S) : Kenneth Mori et al.

It is certified that error appears in the above-identified patent and that said Letters Patent is hereby corrected as shown below:

At column 10, line 4, delete "3" and insert --13--.

Signed and Sealed this

Thirty-first Day of August, 2010

David J. Kappos

David J. Kappos
*Director of the United States Patent and Trademark Office*